United States Patent [19]

Lohoefer

[11] Patent Number: 4,993,043

[45] Date of Patent: Feb. 12, 1991

[54] DEVICE FOR POSITIONING AND MELTING ELECTRICALLY CONDUCTIVE MATERIALS WITHOUT A RECEPTACLE

[75] Inventor: Georg Lohoefer, Aachen, Fed. Rep. of Germany

[73] Assignee: Deutsche Forschungsanstalt fur Luft-und Raumfahrt e.V., Cologne, Fed. Rep. of Germany

[21] Appl. No.: 421,056

[22] Filed: Oct. 13, 1989

[30] Foreign Application Priority Data

Oct. 25, 1988 [DE] Fed. Rep. of Germany ..... 3836239

[51] Int. Cl.[5] ..... H05B 6/02

[52] U.S. Cl. ..... 373/138; 373/147

[58] Field of Search ..... 373/138, 147, 148, 149, 373/150, 151, 139; 219/7.5, 10.67, 10.75, 10.77

[56] References Cited

U.S. PATENT DOCUMENTS

| | | | |
|---|---|---|---|
| 1,744,983 | 1/1930 | Northrup | 373/147 |
| 2,686,864 | 8/1954 | Wroughton et al. | 373/138 |
| 3,644,151 | 2/1972 | Keller | 373/147 |

FOREIGN PATENT DOCUMENTS 3639973 6/1988 Fed. Rep. of Germany .

*Primary Examiner*—Bruce A. Reynolds
*Assistant Examiner*—Tu Hoang
*Attorney, Agent, or Firm*—Spensley Horn Jubas & Lubitz

[57] ABSTRACT

Two coils between which a sample is contactlessly held in a suspended state, form a common part of two different oscillating circuits. A heating oscillating-circuit consists of the two coils and two first capacitors. A positioning oscillating-circuit consists of the two coils and two second capacitors. The current of the heating oscillating-circuit flows through both coils in the same direction, and the current of the positioning oscillating-circuit flows through both coils in opposite directions. Since the two oscillating circuits are not coupled to each other, heating efficiency and positioning efficiency can be set independently from each other. Two coils are sufficient for heating and positioning.

16 Claims, 1 Drawing Sheet

DEVICE FOR POSITIONING AND MELTING ELECTRICALLY CONDUCTIVE MATERIALS WITHOUT A RECEPTACLE

BACKGROUND OF THE INVENTION

1. Field of the Invention

The invention relates to a device for positioning and melting electrically conductive materials without a receptacle.

2. Description of Related Art

It is known to contactlessly melt metals or alloys between two vertically separated coils, through which a high-frequency alternating current flows in respectively opposite direction. The coils have a double function: They serve as positioning coils for holding the sample in the melting area, and they generate eddy currents in the sample by magnetic induction, thereby heating the sample. A sample, arranged under zero-gravity conditions and thus not submitted to any timely constant exterior forces, is fixed in the magnetic field of both coils at the point at which the combined magnetic field of both coils is weakest, or forced back to that point by small mechanic shocks. In doing so, however, the metal sample is located in an area where the value of magnetic flux density, and, thus, also the heat generated by the eddy currents, is lowest. The heating efficiency of a coil arrangement in which a high-frequency current flows through the coils in opposite directions and in phase, which thereby generate a magnetic quadrupole-field, is very low, whereas the positioning forces are comparatively high.

In order to obtain not only high positioning forces, but also a strong heating effect, German Patent publication No. ∓39 973 A1, in addition to the coils generating the positioning field, provides at least one further coil surrounding the melting area, through which a high-frequency current of a higher frequency flows. This further coil serves as a heating coil for a contactless inductive heating of the sample. Since the strength of the magnetic field generated by this coil is greatest in the area of the sample held by the positioning field, the energy of the alternating current flowing in this coil is transformed into melting heat within the sample. However, it is a disadvantage that the two coils generating the positioning field are located very close to the heating coil so that a rather high magnetic field strength prevails in the area between the heating coil and a respective positioning coil. This has the effect that the positioning coils are heated by the heating coils to almost the same degree as the sample itself. This heat has to be cooled down and is lost. On the other hand, the heating coil screens off a large part of the fields of the positioning coils from the sample, thereby significantly reducing their force efficiency, so that a considerable part of the power applied to the positioning coils is also transformed into useless heat.

It is an object of the present invention to provide a device for positioning and melting electrically conductive materials without a receptacle which allows a melting and a positioning of a sample with low heat dissipation and high efficiency.

SUMMARY OF THE INVENTION

The device of the present invention operates with only two coils that serve for the positioning as well as for the heating and melting of the sample and which in each case are connected in series. Both coils form a common part of two different oscillating circuits of different resonant frequencies, wherein the current of the first oscillating circuit flows through the two coils in the same direction whereas the current of the second oscillating circuit flows therethrough in opposite directions. Both currents can superpose each other in the coils. Both oscillating circuits have the two coils in common but are different with respect to their capacitors. The first oscillating circuit forms a heating oscillating-circuit, and the second oscillating circuit forms a positioning oscillating circuit. The high-frequency alternating current of the heating oscillating circuit generates a high-frequency magnetic dipole-field in the coils, having a high field intensity in the area of the sample and thus providing high heat generation for the sample. By the high-frequency alternating current of the positioning oscillating circuit, there occurs, in the coil, a high-frequency magnetic quadrupole-field having low field intensity but a high gradient of field intensity, which field subjects the sample to a high force, at the same time generating only little heat therein. In order to eliminate low-frequency beat (floating) effects of the two superposed magnetic fields, the resonant frequencies of the two oscillating circuits should differ from each other to a sufficient extent. The arrangement and the capacity of both oscillatingcircuit capacitors are now selected such that both oscillating-circuit currents influence each other not at all or only to a desired extent. Thus, current intensity control can be performed separately in both oscillating circuits by different amplifiers so that the user can adjust the heating efficiency and the positioning force independently from each other, respectively.

The invention makes use of the fact that the heat P generated in the sample per time and volume unit is proportional to $B^2$:

$$P=k_1\cdot\vec{B}^2,$$

wherein $k_1$ is a positive proportionality constant and $\vec{B}$ is the magnetic flux density.

The force $\vec{F}$ exerted on the sample per volume unit is $$\vec{F}=k_2\,(-grad\,\vec{B}^2).$$

Thus, this force is proportional to the gradient of the flux density, $k_2$ being the positive proportionality constant. With the dipole-field, P is high and $\vec{F}$ is low in the area of the sample, whereas, with the quadrupole-field, P is low and $\vec{F}$ is high in that area.

By the two oscillating circuits, generating currents of different frequencies, the magnetic dipole and quadrupole parts may be mutually superposed in a selectable relationship, it being possible in extreme cases to operate with a pure dipole-field or a pure quadrupole-field when one of the oscillating circuits has been shut down.

The device according to the present invention is particularly suited for melting and/or cooling electrically conductive materials under conditions of reduced gravity. Its main field of application is the performance of metallurgic tests in spacecrafts. It is of particular importance to avoid contact between the sample and the walls of a melting pot or the like, if the object is to cool a sample to a temperature far below the melting temperature, without a solidifying of the sample, since walls of melting pots are nuclei of crystallization. The device of the present invention allows both a melting of the sample and a stable positioning of the sample when cooling it. The improved electric efficiency of the device is a main advantage over known devices. This is of particular importance for applications in space, since the disposable amount of electric energy is limited there.

BRIEF DESCRIPTION OF THE DRAWINGS

A preferred embodiment of the invention will be described hereunder in greater detail with respect to the accompanying drawings.

In the drawings

DESCRIPTION OF THE PREFERRED EMBODIMENT

Figure 1:
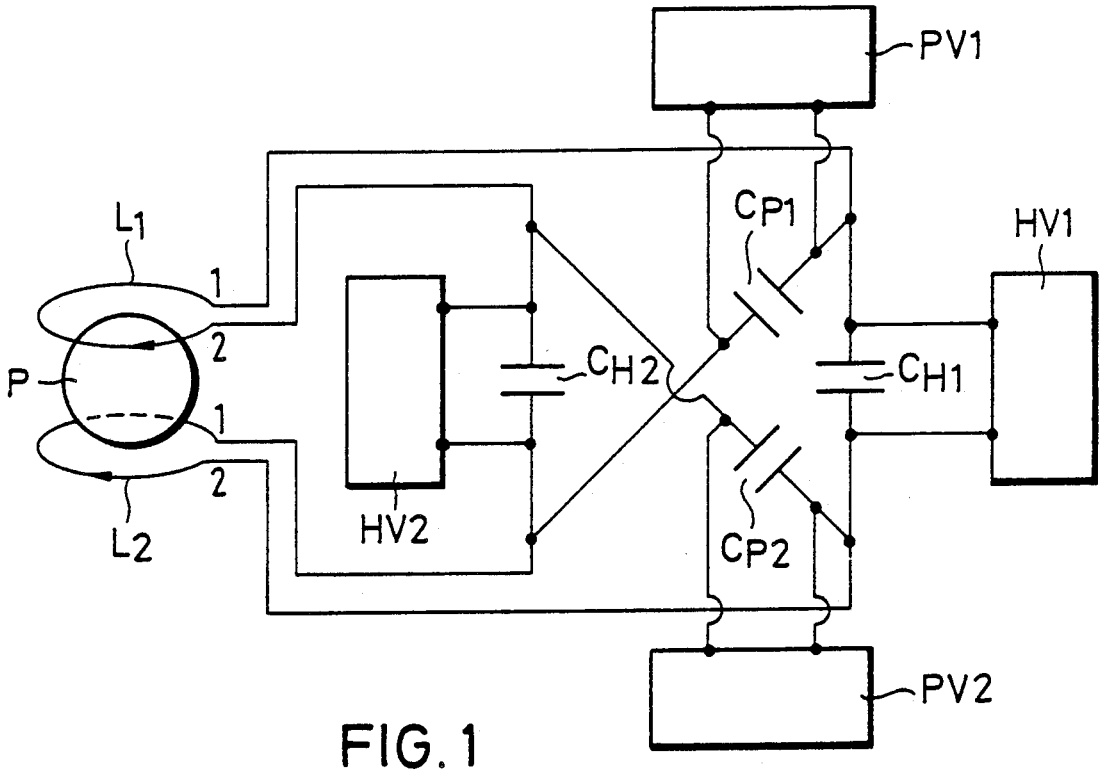
FIG. 1 is a schematic illustration of a preferred embodiment of the electric circuit of the device.

The device illustrated in FIG. 1 comprises two parallel coils $L_1$ and $L_2$, the axes of which coincide and which are axially spaced apart. In the space between said coils and along the axis, the melting area is located, having arranged therein the sample P which, by the magnetic fields of the coils, is held in a suspended state and is positioned against lateral deviation. The coils $L_1$ and $L_2$, which, for reasons of clarity, are each shown by only one winding in the figures, can also comprise a plurality of windings. The coils may be provided as pipes having a coolant flowing therethrough.

Figure 2:
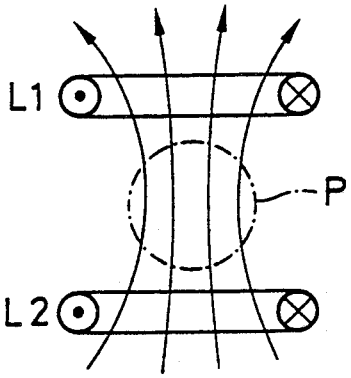
FIG. 2 is a side elevational view of the coils in the dipole-mode with the magnetic field illustrated.

The first end 1 of one coil $L_1$ is connected, through a first capacitor $C_{H1}$, to the second end 2 of the other coil $L_2$. Further, the second end 2 of said one coil $L_1$ is connected, through another first capacitor $C_{H2}$, to the first end 1 of the other coil $L_2$. Thus, the two coils, together with the first capacitors $C_{H1}$ and $C_{H2}$, form a closed circuit arranged as an oscillating circuit. This circuit acts as the heating circuit. An alternating current flowing in this oscillating circuit has the same direction in the two coils $L_1$ and $L_2$, thus generating the dipole-field of FIG. 2 for heating the sample P.

Figure 3:
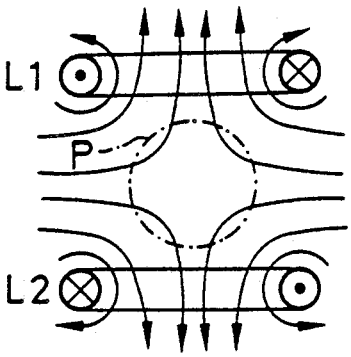
FIG. 3 is a side elevational view of the coils in the quadrupole-mode with the magnetic field illustrated.

Further, the first end 1 of said one coil $L_1$ is connected, through the second capacitor $C_{P1}$, to the first end 1 of the other coil $L_2$, and the second end 2 of the one coil $L_1$ is connected, through another second capacitor $C_{P2}$, to the second end 2 of the other coil $L_2$. The coils $L_1$ and $L_2$, together with the second capacitors $C_{P1}$ and $C_{P2}$, form a further oscillating circuit, the alternating current of this circuit flowing through the coils in opposite directions. Thereby, the quadrupole-field of FIG. 3 for positioning the sample P is generated.

To effect positioning of the sample P under zero-gravity conditions in the center between the coils by the magnetic quadrupole-field, both coils should have, to the highest possible extent, the same magnetic inductivity and the same electric resistance. This means that both coils should be identical in design.

For compensation of the energy losses in the heating circuit, the first capacitor $C_{H1}$ is connected to the two terminals of a heating amplifier $HV_1$, and the first capacitor $C_{H2}$ is connected to the two terminals of a further heating amplifier $HV_2$. Both heating amplifiers $HV_1$ and $HV_2$ are alternating-current amplifiers which, via a feed-back element, are commonly driven by the oscillation in the heating circuit.

In a similar manner, the second capacitor $C_{P1}$ is connected to the two terminals of of a positioning amplifier $PV_1$, and the second capacitor $C_{P2}$ is connected to the two terminals of a positioning amplifier $PV_2$. The positioning amplifiers $PV_1$ and $C_{P2}$ serve for compensating the energy losses occuring in the positioning oscillating-circuit and are also commonly driven, through a feed-back element, by the oscillation in the positioning circuit.

For preventing the currents in the two oscillating circuits from influencing each other and for allowing independent control of these oscillating circuits and, respectively, for deliberately controlling the mutual influence of the two oscillating circuits, one of the following preconditions should preferably be fulfilled:

1. $C_{H1}=C_{H2}$, $C_{P1}\neq C_{P2}$, wherein one of the two capacitors $C_{P1}$ or $C_{P2}$ may also be short-circuited;
2. $C_{P1}=C_{P2}$, $C_{H1}\neq C_{H2}$, wherein one of the two capacitors $C_{H1}$ or $C_{H2}$ may also be short-circuited;
3. $C_{H1}=C_{H2}$, $C_{P1}=C_{P2}$.

These preconditions also mean that $C_{H1}=C_{H2}$ and/or $C_{P1}=C_{P2}$ should preferably be fulfilled. Particularly in the above-mentioned third case, the mutual independence of the two oscillating-circuit currents is immediately evident. When a current oscillates in the heating oscillating-circuit formed by the two identically designed coils $L_1$ and $L_2$ and the first capacitors $C_{H1}$ and $C_{H2}$, this means that, because the capacities of these two capacitors are equal, the voltage across the second end 2 of the one coil $L_1$ is equal at all time to the voltage across the second end 2 of the second coil $L_2$, and the voltage across the first end 1 of the one coil L is equal to the voltage across the first end 1 of the other coil $L_2$. Thus, no alternating current flows through the second capacitors $C_{P1}$ and $C_{P2}$ which belong to the positioning oscillating-circuit. The same also applies to the positioning oscillating-circuit formed by the two coils and the second capacitors $C_{P1}$ and $C_{P2}$. Therefore, the currents of the two oscillating-circuits oscillate with their respective resonant frequency without influencing each other. Consequently, the strengths of the magnetic positioning field and the magnetic heating field can be set and controlled independently from each other. For preventing low-frequency oscillations of the two superposed magnetic fields for positioning and heating, which oscillations might cause mechanical vibrations of the sample, the resonant frequencies of the two oscillating circuits should sufficiently differ from each other.

I claim:

1. A device for melting and positioning electrically conductive materials without a receptacle, comprising a coil arrangement of two coils arranged on opposite sides of a melting area, both coils having high-frequency currents flowing therethrough, characterized in that the two coils, together with at least one first capacitor, are connected to form a first oscillating circuit in such a manner that, in the first oscillating circuit, current is flowing through the two coils in the same direction, that the two coils, together with at least one second capacitor, are connected to form a second oscillating circuit in such a manner that, in the second oscillating circuit, current is flowing through the two coils in opposite directions, and that each of the two oscillating circuits is connected to an amplifying means for compensating the energy losses in the oscillating circuits.

2. The device according to claim 1, wherein a first end of one coil is connected, through a first capacitor, to a second end of the other coil, and a second end of said one coil is connected, through a further first capacitor, to a first end of the other coil.

3. The device according to claim 1, wherein a first end of one coil is connected, through a second capacitor, to a first end of the other coil, and a second end of said one coil is connected, through a further second capacitor, to a second end of the other coil.

4. The device according to claim 2 comprising at least two first amplifiers, wherein each of the first capacitors is connected to a respective first amplifier, and wherein the two first amplifiers are commonly driven.

5. The device according to claim 3 comprising at least two second amplifiers, wherein each of the second capacitors is connected to a respective second amplifier, and wherein the two second amplifiers are commonly driven.

6. The device according to claim 2, wherein the two first capacitors have equal capacities.

7. The device according to claim 3, wherein the two second capacitors have equal capacities.

8. The device according to claim 1, wherein both coils are identical in design.

9. A device for positioning and melting electrically conductive materials, the device comprising:

a first pair of capacitors, a second pair of capacitors, a first coil, a second coil, the first coil and the second coil being arranged on substantially opposite sides of a melting area, a first oscillating circuit, formed by the first and second coil and at least one of the first pair of capacitors, in which current flows through the first and second coils in the same direction, a second oscillating circuit, formed by the first and second coil and at least one of the second pair of capacitors, in which current flows through the first and second coils in opposite directions, and amplifying means for compensating energy losses in the first oscillating circuit and the second oscillating circuit.

10. The device according to claim 9, wherein the first coil defines a first end and a second end, the second coil defines a first end and a second end, the first pair of capacitors includes a first capacitor and a second capacitor, and wherein the first end of the first coil is connected to the second end of the second coil through the first capacitor, and the second end of the first coil is connected to the first end of the second coil through the second capacitor.

11. The device according to claim 9, wherein the first coil defines a first end and a second end, the second coil defines a first end and a second end, the second pair of capacitors includes a first capacitor and a second capacitor, and wherein the first end of the first coil is connected to the first end of the second coil through the first capacitor, and the second end of the first coil is connected to the second end of the second coil through the second capacitor.

12. The device according to claim 10, further comprising:

a first amplifier connected to the first capacitor, a second amplifier connected to the second capacitor, the first amplifier and the second amplifier being commonly driven.

13. The device according to claim 11, further comprising:

a first amplifier connected to the first capacitor, a second amplifier connected to the second capacitor, the first amplifier and the second amplifier being commonly driven.

14. The device according to claim 10, wherein the first capacitor and the second capacitor have substantially equal capacitance.

15. The device according to claim 11, wherein the first capacitor and the second capacitor have substantially equal capacitance.

16. The device according to claim 9, wherein the first coil and the second coil are identical in design.

* * * * *